United States Patent [19]

Logan

[11] 4,158,977

[45] Jun. 26, 1979

[54] MAT CUTTER USING SUPPORTED RAZOR BLADE

[76] Inventor: Malcolm Logan, 284 Shady Dr., Palatine, Ill. 60657

[21] Appl. No.: 858,832

[22] Filed: Dec. 8, 1977

[51] Int. Cl.[2] ..... B26D 7/00

[52] U.S. Cl. ..... 83/522; 30/293; 83/527; 83/564; 83/581; 83/614; 83/745

[58] Field of Search ..... 30/293, 289, 287, 2; 33/76; 83/614, 581, 455, 564, 527, 522, 745

[56] References Cited

U.S. PATENT DOCUMENTS

| | | | |
|---|---|---|---|
| 3,527,131 | 9/1970 | Elberin | 83/614 X |
| 3,973,459 | 8/1976 | Stowe | 83/614 X |
| 3,996,827 | 12/1976 | Logan | 83/614 X |
| 4,038,751 | 8/1977 | Albright | 30/293 |

*Primary Examiner*—J. M. Meister

*Attorney, Agent, or Firm*—Eugene F. Friedman

[57] ABSTRACT

A mat cutter employing a razor blade and providing protection against the blade's bending towards either of its sides. The cutter, used for preparing mats for photographs and other art objects, has a base upon which it sits and a section which slopes upward. A holder for a razor blade pivotally attaches to the sloping section and can rotate the blade into and out of a cutting position. When in its cutting position, the blade fits inside of a slot in the base and extends beyond only enough to effect the 45° desired cut. The two sides of the slot prevent the blade from flexing towards either of its flat sides. With the blade thus surrounded and hidden from view, the cutter also employs a marking device that allows the proper placement of the cutter from a mat's edge to cut along a desired line. The cutter also includes starting and stopping marks so that it may produce a cut of the desired length using similar lines along the other sides of the mat. A long straight guide may find use with the cutter to keep its blade on a straight line. A clamping device limits, but does not prevent, freedom of movement of the bar. It does, however, allow the operator to hold it in place using only one hand. The cutter and the guide have interlocking grooves and ridges which keeps the cutter on a straight line without wearing down the edge of either.

18 Claims, 13 Drawing Figures

MAT CUTTER USING SUPPORTED RAZOR BLADE

BACKGROUND

Various types of cutting instruments and machines have found use in shaping different kinds of flat materials. Leather-, paper-, and metal-cutting tools represent popular examples of these.

Mats used in framing photographs and other pictures must also undergo shaping prior to their use. In particular, they must have an appropriately shaped hole cut into them to provide the esthetically pleasing framing for the drawing or other objects with which it finds use. Cutting this inside opening presents particular problems not encountered when cutting the outer edges of the mat or with the other types of materials mentioned above. To provide a pleasing frame for its picture, the inner opening of the mat must have a bevelled edge directed in towards the picture. Even though the mat only has a composition of cardboard, cutting this bevelled edge accurately and precisely represents a most difficult problem.

To provide a thin slit in the mat when cutting this opeing, most cutters employ a blade held in some form of a clamp. The cutter tilts the clamp and thus the blade at an angle relative to its base to provide the bevelled edge. The thin blade allows, of course, for the production of a sharp precise slit into the matting material. Examples of this type of mat cutter appear in, inter alia, U.S. Pat. Nos. 611,238 to P. Drinkaus, 3,130,622 to W. F. Eno, 3,213,736 to W. B. Keeton, 3,463,041 to M. Shapiro et al., and 3,527,131 to C. Elberin et al.

A thin blade, such as a razor blade, should encounter minimal reisitance and friction as it enters into and cuts through the matting material. Nonetheless, it still does not provide for a perfectly precise bevelled edge on the inside of the matting frame. The blade demonstrates a tendency to flex or "walk", which results in deviations from perfection. This fault almost always appears in the inner corners of mats having bevelled edges. To minimize these deviations, most mat cutters place their blade at an angle no greater than 30° relative to the normal of the surfaces of the matting material. This unfortunately represents a severe limitation since a 45° angle would provide a larger bevelling effect, a more pleasing appearance, and allow the use of thinner mats. The presently used mat cutters, consequently, do not produce the desired 45° bevel and have serious imperfections in the mats they do produce.

SUMMARY

A mat cutter generally has a base with a substantially flat surface to sit upon the matting material. It also has a sloping upright member which affixes to the base and provides support for the cutting blade. In mat cutters, this member often makes a nonzero angle relative to the vertical direction.

A retaining device, for holding the blade, rotationally couples to the upright member. There, it can pivot between two positions. In the first, it extends the cutting blade beyond the base's flat surface where it can cut the mat. The second position keeps the blade above the base where it will not mar the underlying surface.

To support the blade, the cutter includes two stiffening devices coupled to the base. Each of the devices prevents the blade, as it cuts, from flexing in the direction away from one of its two flat surfaces. With this protection on both of its sides, the blade produces a precise cut into the mat even at 45°.

The stiffeners generally assume the form of surfaces applied to either side of the blade in its cutting position. These surfaces may conveniently result from a slot provided in the base with edges closely adjacent of the blade's flat surfaces.

While these stiffeners effectively support the blade, they nonetheless hide the blade, as it cuts, from view. The operator's task could well become impossible if he could not see the blade to position it and to know where to start and stop.

However, the cutter may also include alignment devices and markings to overcome this problem. First, a ruler producing markings deviating from true lengths allows the operator to draw lines on the mat for the cutter's edge to follow. The discrepancy of the marked distances from the true values compensates for the distance between the cutter's edge and the blade's location as it extends through the slot in the base.

The cutter's base may also display two markings that determine the starting and ending points of the cut into the mat. They make use of similarly offset lines drawn along the mat's edges running perpendicularly to the cut being made. The distance between the two marks on the cutter again compensates for the distance between the line drawn on the mat and the actual location of the cut in those directions.

The cutter may also have a guide to assist it in making straight cuts. An ordinary stiff ruller may produce acceptable mats. However, the matting material presents substantial resistance to the blade's passage. The effort to move the blade through the mat may cause the cutter to depart from the ruler's edge. Moreover, repeatedly jamming the cutter against the ruler's edge may cause the cutter to deviate from linearity.

A useful guide should require no more than one of the operator's hands to hold it steady during the cutting process. This frees his other hand to control the cutter. Consequently, the guide should have an anchoring device that keeps at least one point at a relatively fixed location across a flat working surface. The operator may then hold the guide at a location remote from this point to keep it still during the actual cutting process. A slight roughening of the guide's bottom will help maintain its positioning.

To cut, the cutter will normally follow a straight edge that generally runs most of the guide's length. During this process, the guide should restrain the blade from moving away from a predetermined distance from the guide's edge.

DETAILED DESCRIPTION

Figure 1:
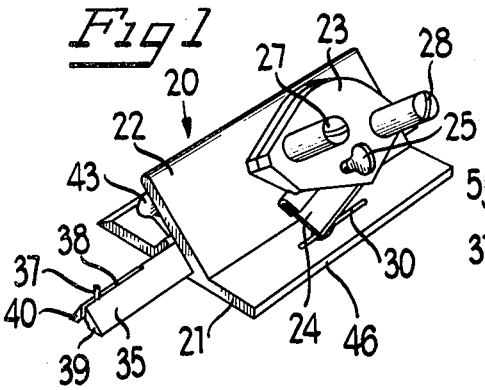
FIG. 1 gives a perpective view of a mat cutter having a supported blade.
Figure 2:
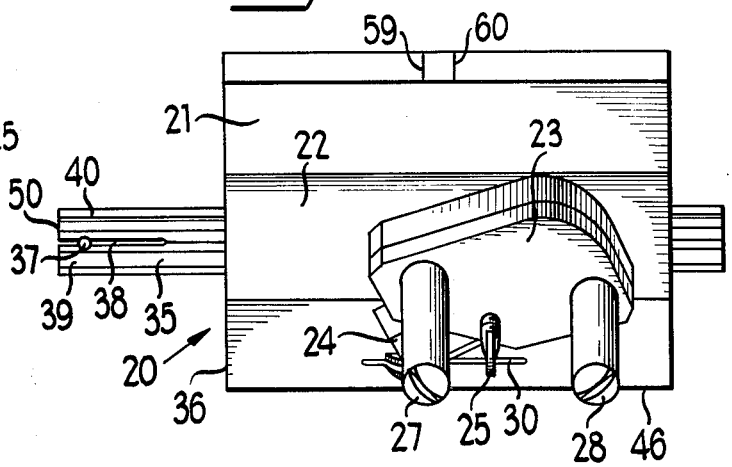
FIG. 2 has a top plan view of the cutter of FIG. 1.
Figure 5:
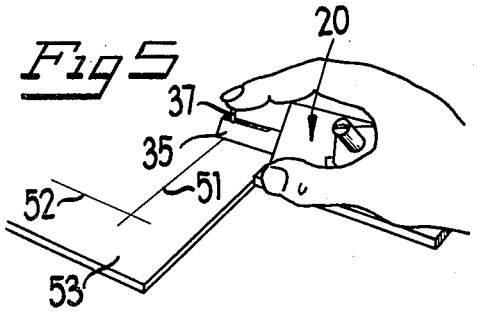
FIG. 5 shows the mat cutter drawing lines that its edge may follow to cut an appropriately sized mat.

The mat cutter, shown generally at 20 in FIGS. 1 and 2 has the base 21 to which attaches the sloping member 22. The blade holder 23 rotationally couples to the member 22 and holds the usual razor blade 24. The screw 25 secures the blade 24 in its holder 23.

The two posts 27 and 28 provide leverage to the operator's fingers to pivot the holder 23. In particular, the posts 27 and 28 allow the operator to pivot the blade 24 into the slot 30 in the base 20 in order to cut a mat.

Figure 3:
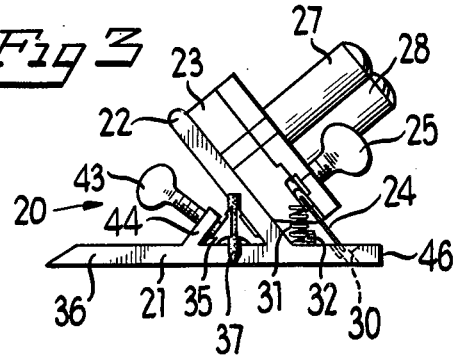
FIG. 3 portrays the cutter of the previous figures in an end elevational view.

Other details of the cutter 20 appear in FIG. 3. That figure shows the spring 31 extending between the base 21 and the blade holder 23. It urges the holder 23 upwards as shown in the figure. In this position the blade remains above the bottom of the base 21. This keeps it from unintentionally marring a surface upon which placed.

Also, FIG. 3 shows that the member 22, the blade holder 23 and the blade 24 sit at an angle of 45° relative to the base 21. This allows the blade 24 to cut a bevel of 45° in a mat upon which the base 21 sits.

Moreover, the slot 30 through the base 21 also displays an angle of 45° relative to the base 21. Thus, it protects the blade 24 at any position in which the blade holder 23 places it.

Further, the screw 32 passes through the base 21 and upwards towards the blade holder 23. As its function, it limits the downward movement of the holder 23. Doing so, it controls the depth at which the blade 24 cuts in order that it will not extend substantially beyond the bottom surface of the mat. The adjustability of the screw 32 allows the cutter to operate upon mats of different thicknesses.

Figure 4:
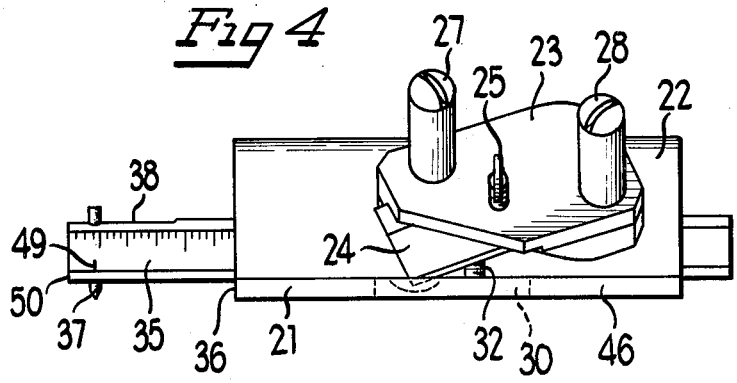
FIG. 4 gives a front elevational view of the same cutter.

FIG. 4 shows the ruler 35 extending beyond the edge 36 of the base 21. The marker 37 fits into the slot 38 (seen better in FIGS. 1 and 2) passing through part of the ruler 35. The slot 38 allows the two sections 39 and 40 to separate enough for the insertion of the marker 37.

The screw 43, seen in FIG. 3, passes through the section 44 and bears against the ruler 35. It keeps the marker 37 at the preset distance away from the edge 36 so that it may mark a mat for cutting.

The markings on the ruler 35 allow the operator to place the front edge 46 of the cutter on the drawn line. He can then cut at the appropriate distance from the mat's edge to provide a border of the desired width.

As seen in FIG. 3, however, the blade 24 cuts at a distance inside the front edge 46. The drawn line, accordingly, must compensate for the distance between the edge 46 and the blade 24. As shown in FIG. 4, the marker 37 sits at the line 49 on the ruler 35. The distance between the marker 49 and the ruler's end 50 equals the distance between the blade 24 and the cutter's front edge 46.

Thus, to cut a 1½ inch border, the operator moves the ruler until the 1½ inch mark aligns with the cutter's side edge 36, as shown in FIG. 4. He then tightens the screw 43 to maintain this positioning of the ruler 35.

Figure 6:
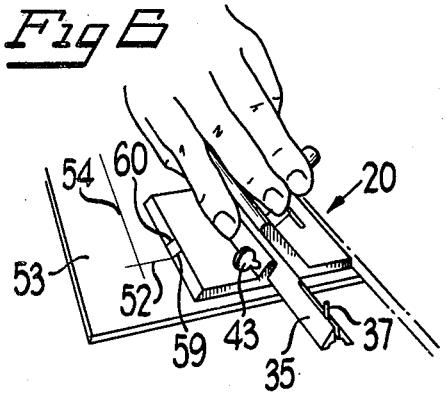
FIGS. 6 and 7 show the cutter in its beginning and ending positions, respectively, for making a cut in a mat.
Figure 7:
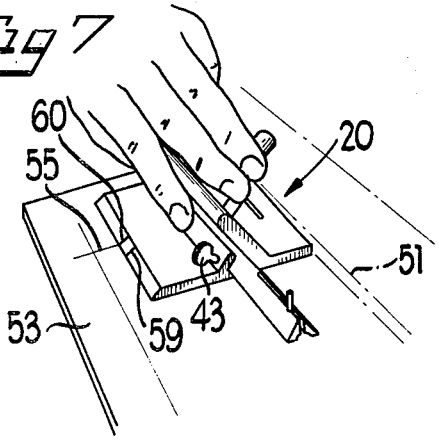

Subsequently, he draws the lines 51 and 52 on the mat 53 with the marker. The lines 51 and 52, as well as the other two lines 54 and 55 in FIGS. 6 and 7, lie closer to the edge than the desired 1½ inches. However, placing the cutter's front edge 46 on these lines will produce the desired border due to the offset between the front edge 46 and the blade 24.

Since the lines 51 and 54 do not mark the desired border, finding the locations to start and end the cut becomes a problem. Cutting the entire distance between the lines 52 and 55 will put cuts into the desired border. The marks 59 and 60 on the cutter 20 determine the starting and ending points for a cut. Thus, aligning the mark 59 with the line 52, as in FIG. 6, will start the cut at 1½ inches from the edge of the mat 53. Stopping the cut when the mark 60 reaches the drawn line 55 will stop the blade 24 at the desired distance from the edge of the mat 53.

Figure 8:
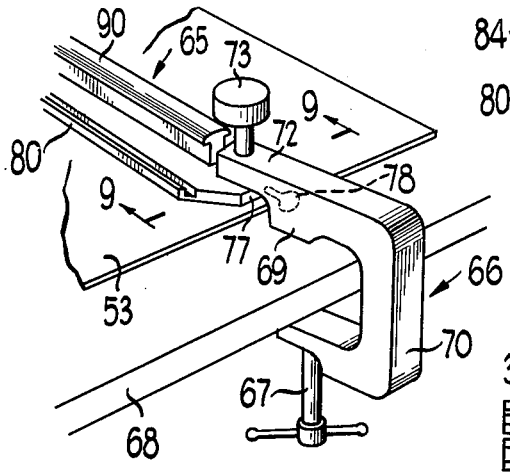
FIG. 8 depicts part of a guide bar and an anchoring device which helps keep the guide in place during the cutting operation.

FIG. 8 shows a guide bar, generally at 65, and an anchoring clamp at 66 which assist in providing a straight cut. The clamp 66 has the bolt 67 which squeezes the flat surface 68 against the projection 69. Thus, the bolt 67, the projection 69, and the back 70 clamp the anchoring device 66 onto the working surface 68.

Figure 9:
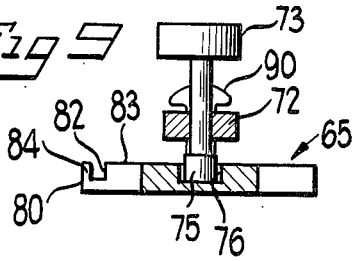
FIG. 9 gives a cross-sectional view along the line 9—9 of the guide bar and anchor of FIG. 8.

The anchor 66 also has the leg 72 which extends from the front of the depending projection 69. The thumb bolt 73 extends through a threaded opening in the leg 72 of the anchor 66. Its tip 75, as shown in FIG. 9, sits inside a hole 76 formed near the end 77 of the guide bar 65. The screw 78, shown in phantom in FIG. 8, keeps the bolt's tip 75 attached to the guide bar 65.

Figure 10:
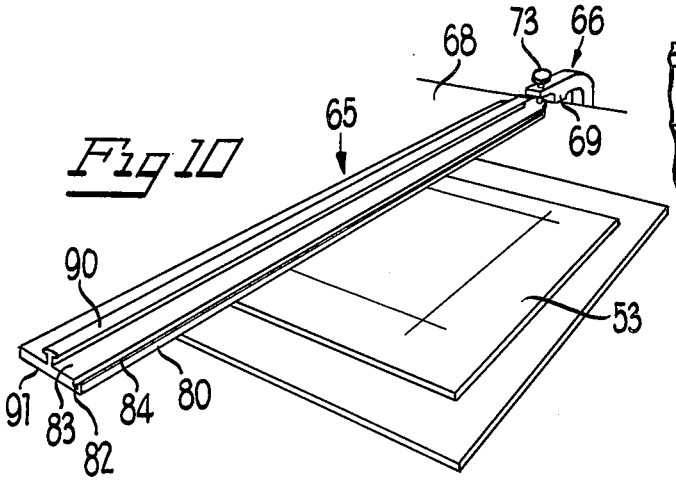
FIG. 10 depicts the guide bar of the previous figures on a marked mat in preparation for making the first cut.

As FIG. 9 shows, the tip 75 can pivot about the remainder of the bolt 73. Thus, when attached to the tip 75, the bar 65 can rotate, at least slightly, about three independent axes passing through the tip 75. This allows the operator to lift the bar 65 to place a mat 53 underneath it. He can move the bar 65 around to align its straight edge 80 with a line drawn on the mat 53. FIG. 10 shows the straight edge 80 aligned with a drawn line on the mat 53.

Also shown in FIGS. 9 and 10, the bar 65 has the groove 82 cut into its top 83. Closer to the edge 80, the guide bar has the ridge 84 running substantially all of its length.

Figure 11:
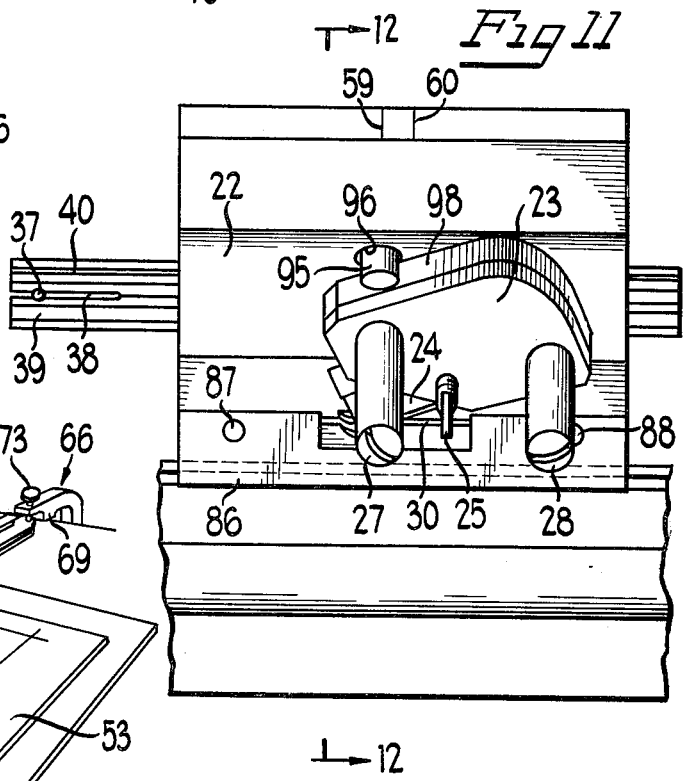
FIG. 11 shows a cutter in place on the guide bar.

The cutter 20 in FIG. 11 has the ridge 86 attached to its front edge 46 by the rivets 87 and 88. Between the ridge 86 and the front edge 46, the cutter has the groove 87.

Figure 12:
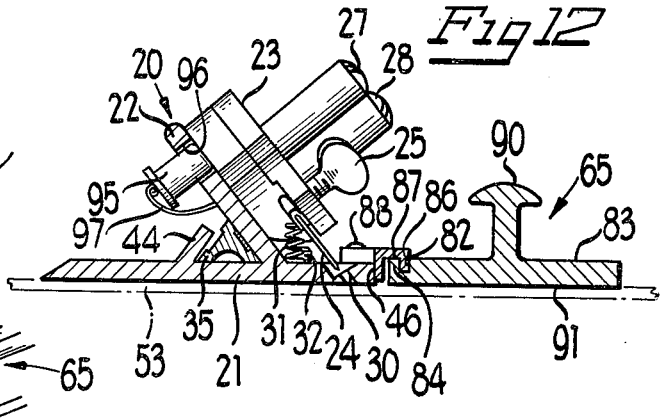
FIG. 12 gives a cross-sectional view along the line 12—12 of the cutter and guide bar of FIG. 11.

As seen in FIG. 12, the ridges 84 and 86 and the grooves 82 and 87 of the bar 65 and the cutter 20, respectively, complement each other. The ridge 86 of the cutter 20 points downward and fits into the bar's groove 82 whose opening faces upward. Similarily the upward pointing ridge 84 of the bar 65 fits into the cutter's groove 87 which opens downward. This relationship of the grooves 82 and 87 and ridges 84 and 86 allows the operator, after adjusting the bolt 73 to apply pressure to the mat 53, to first align the bar's edge 80 with the line drawn on the mat. He then places the cutter 20 adjacent to the edge 80 with the appropriate ridge fitting into its groove.

The operator may then proceed to cut the mat. With one hand, he applies pressure to the rounded projection 90 of the bar 65 to keep it from moving during the process. A roughened bottom surface 91 of the bar 65 will help in this effort.

Figure 13:
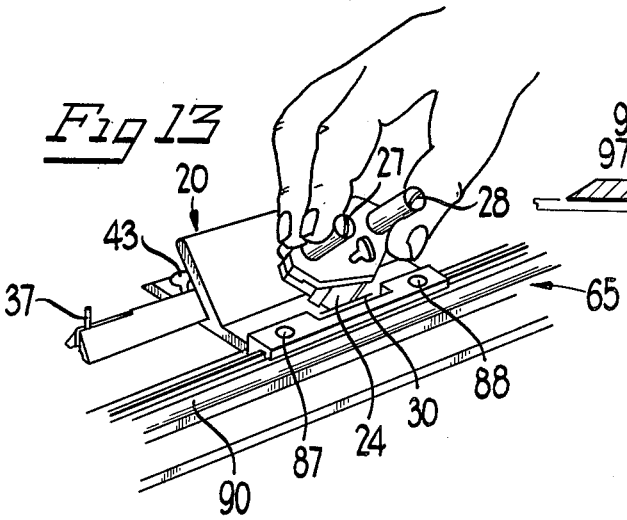
FIG. 13 shows the cutter as it follows the guide bar to make a cut.

With his other hand, as seen in FIG. 13, he pushes down on the post 27 and up on the post 28. This rotates the blade 24 into the mat. He then pulls the cutter 20 along the guide bar 65 to make the desired cut. The complementary grooves 82 and 87 and ridges 84 and 86 keep the blade 24 at a constant predetermined distance away from the bar's edge 80. A straight cut with a 45° bevel represents the result.

As the cutter 20 moves along the edge 80 of the guide 65, neither the blade 24 nor the cutter's front edge 46 rub against the bar's edge 80. As a result, the edge 80 suffers substantially no wear and remains a true straight line.

The exertion on the posts 27 and 28 required to keep the blade 24 in the mat may exceed the force some people have in their fingers. Consequently, the cutter 20 in FIGS. 11 and 12 includes the pin 95 inserted into the opening 96 of the upright member 22 from its back. The spring 97 urges the pin toward the blade holder 23.

To move the blade 24 in the cutting position, the holder 23 rotates until it no longer overlies the opening 96. The pin 95, under the influence of the spring 97, pops outward, or to the front in FIG. 11. It then abuts the upper edge 98 of the blade holder 23 and prevents it rotating upward and, thus, keeps the blade 24 in its cutting position.

To retract the blade 24 from the slot 30, the operator, with a finger, overcomes the force of the spring 97 and depresses the pin 95. This then allows the blade holder 23 to pivot and pull the blade 24 to a position above the bottom of the cutter's base 21 as shown in FIG. 12.

The pin 95, under the action of the spring 97, may also have the ability to retain the blade holder 23 and the blade 24 in its raised, or noncutting, position. When that happens the spring 31 becomes dispensible.

Accordingly, what is claimed is:

1. A mat cutter comprising:

(A) a base having a substantially flat furface;

(B) a sloping upright member rigidly affixed to said base at an angle relative thereto;

(C) retaining means, movably coupled to said upright member, for holding a thin cutting blade in a predetermined position relative to itself, said retaining means moving between a first position and a second position and, when holding said blade, extending a part of said blade beyond said flat surface when in said first position and not extending any part of said blade beyond said flat surface when in said second position;

(D) first stiffening means, rigidly affixed to said base, for, when said retaining means holds a blade and occupies said first position, preventing substantial bending of said blade in the direction of one of the flat surfaces of said blade; and (E) second stiffening means, rigidly affixed to said base, for, when said retaining means holds a blade and occupies said first position, preventing substantial bending of said blade in the direction of the other of the flat surfaces of said blade.

2. The cutter of claim 1 wherein said stiffening means includes a section of rigid material lying, when said holding means holds said blade and is in said first position, closely adjacent to one side of said blade, and said second stiffening means includes a second section of rigid material lying, when said holding means holds said blade and is in said first position, closely adjacent to the second side of said blade, and said first and second stiffening means extend substantially to the plane of said flat surface of said base.

3. The cutter of claim 2 wherein said first and said second sections of material are formed from one piece of material having a slot therein and said blade, when held by said retaining means with said retaining means in said first position, passes through said slot, the edges of said slot having a space between them slightly larger than the thickness of said blade.

4. The cutter of claim 3 wherein said base and said sloping member are formed integrally with each other.

5. The cutter of claim 4 wherein said retaining means holds a razor blade.

6. The cutter of claim 5 wherein said first and said second stiffening means constitute part of said base and, when said retaining means holds a blade and is in said first position, run from a sharp edge of said blade to another edge of said blade.

7. The cutter of claim 6 wherein said base has an edge falling on a straight line and further including locating means for placing a straight guide line on a mat with a straight edge so that, when said cutter, with said retaining means holding a blade and occupying said first position, is pulled along said mat with said straight edge of said cutter remaining adjacent to said guide line, said blade will cut a slit into said mat at a predetermined distance from said straight edge of said mat.

8. The cutter of claim 7 wherein said guide line is a first guide line and further including (1) starting-position determining means for positioning said cutter relative to a second guide line perpendicular to said first guide line so that when said cutter cuts said slit into said mat, said slit will begin at a predetermined nonzero distance away from said second guide line and (2) end-position determining means for providing an indication, relative to a third guide line perpendicular to said first guide line and parallel to said second guide line, that said blade has cut said straight line up to said predetermined nonzero distance away from said third guide line.

9. The cutter of claim 8 wherein said locating means includes a ruler having listed distances between a particular point and other points but wherein said listed distances are not equal to the actual distance between said particular point and said other points but is smaller by an amount equal to the distance between said straight edge of said cutter and the opening of said slot through said flat surface of said cutter, and wherein said nonzero distance is equal to said amount.

10. The cutter of claim 9 wherein said beginning-position determining means is a first mark on said base and said end-position determining means is a second mark on said base removed from said first mark.

11. The cutter of claim 10 wherein said sloping upright member makes an angle of 45° relative to said base and said retaining means holds said blade at an angle of 45° relative to said flat surface of said base.

12. The cutter of claim 6 including locking means for maintaining said retaining means in said first position.

13. The cutter of claim 12 further including depth-setting means fo changing the orientation of said retaining means, when in said first position, relative to said flat surface of said base.

14. The cutter of claim 13 wherein said sloping upright member makes an angle of 45° relative to said base and said retaining means holds said blade at an angle of 45° relative to said flat surface of said base.

15. The cutter of claim 13 further including spring means for, when said retaining means is not in said second position, exerting a torque against said retaining means in a direction to move said retaining means towards said second position.

16. The cutter of claim 13 further including holding means for, when said retaining is in said second position, preventing said retaining means, under the force of its own weight and of the weight of a blade held by it, from moving from said second position towards said first position.

17. The cutter of claim 16 wherein said locking means includes a pin coupled to said sloping member and, when said retaining means is in said first position, abutting against the edge of said retaining means toward which said retaining means must move to go from said first position to said second position.

18. The cutter of claim 17 wherein said depth-setting means includes a screw set into said base pointing toward said retaining means for limiting the travel of said retaining means from said second position towards said flat surface of said base.

* * * * *